US005099661A

United States Patent [19]

Kitagawa

[11] Patent Number: 5,099,661

[45] Date of Patent: Mar. 31, 1992

[54] CIRCULAR KNITTING MACHINE

[75] Inventor: Kyoya Kitagawa, Hyogo, Japan

[73] Assignee: Precision Fukuhara Works, Ltd., Hyogo, Japan

[21] Appl. No.: 561,341

[22] Filed: Jul. 31, 1990

[30] Foreign Application Priority Data

Aug. 18, 1989 [JP] Japan ..... 1-213170

[51] Int. Cl.[5] ..... D04B 9/06

[52] U.S. Cl. ..... 66/19; 66/140 R

[58] Field of Search ..... 66/19, 28, 95

[56] References Cited

U.S. PATENT DOCUMENTS

| | | | |
|---|---|---|---|
| 1,461,693 | 7/1923 | Bromley et al. | 66/28 |
| 1,745,678 | 2/1930 | Howie | 66/28 X |
| 4,385,507 | 5/1983 | Sawazaki | 66/140 R |
| 4,459,830 | 7/1984 | Tsuchiya et al. | 66/140 S |
| 4,718,256 | 1/1988 | Lonati | 66/95 |

FOREIGN PATENT DOCUMENTS

| | | | |
|---|---|---|---|
| 2609101 | 10/1976 | Fed. Rep. of Germany | 66/95 |

*Primary Examiner*—Werner H. Schroeder
*Assistant Examiner*—John J. Calvert
*Attorney, Agent, or Firm*—Bell, Seltzer, Park & Gibson

[57] ABSTRACT

A circular knitting machine is constructed for facilitating replacement of the needle cylinder and dial element without the necessity of hoisting the dial by means such as a chain block. The circular knitting machine includes a circular dial element supported adjacent the opening in the upper end of the needle cylinder. A rotatable drive shaft is supported at the upper end of a frame support member and extends downward to a position adjacent the circular opening in the upper end of the needle cylinder. A vertically extending support sleeve surrounds the drive shaft and is supported at the upper end on the frame support member for telescopic vertical movement relative to the drive shaft. The lower end of the support sleeve is fixed to the dial for supporting same. A dial control is provided for lifting and lowering the support sleeve along the drive shaft to lift the dial element a sufficient distance to permit removal and replacement of the needle cylinder.

5 Claims, 3 Drawing Sheets

CIRCULAR KNITTING MACHINE

FIELD OF THE INVENTION

This invention relates to circular knitting machines and in particular to a double knit circular knitting machine having a dial element which is supported in such a manner that it can be lifted a sufficient distance for facilitating removal and replacement of the needle cylinder.

BACKGROUND OF THE INVENTION

In a conventional double knit circular knitting machine, the machine shaft is rotatably supported in the machine by bearings fitted into a fixed inner sleeve support member. A dial support member is mounted on the upper surface of a stepped portion of the machine shaft and fixed thereto by bolts extending from the underside. The dial is positioned on the upper surface of the dial support member. A large gear is fitted to the upper end of the machine shaft and retained thereto by a key. Dial control cams are fixed to the inner sleeve support member on a dial cam holder. Vertical movement of this member is controlled by an adjusting nut fixed to the sleeve support frame. Additionally, some knitting machines include various yarn changing and selection devices, commonly referred to as stripper boxes.

The complex nature of this type of knitting machine mandates periodic maintenance and repair which can include replacement and removal of heavy parts such as the cylinder and sinker dial. Typically, when heavy parts such as the cylinder and sinker dial are removed, these members are hoisted from the machine by a chain block. If the knitting machines are stored in a building with a limited ceiling height, hoisting of these component members is almost impossible. Additionally, if floor space is limited, hoisting and then unloading of the removed component members onto the floor is difficult.

SUMMARY OF THE INVENTION

It is therefore an object of this invention to provide a circular knitting machine which is constructed to facilitate more ready replacement of the needle cylinder and dial element.

These and other objects and advantages of the present invention are accomplished by a circular knitting machine which is constructed for facilitating ready replacement of a cylinder and dial element. The knitting machine includes a frame and a bed plate fixed on the frame. A needle cylinder is supported for rotation on the bed plate and includes needles supported for vertical movement therein.

The needle cylinder has a circular opening at the upper end thereof and a circular dial element supported adjacent to the circular opening in the upper end of the needle cylinder. A frame support member extends in spaced relationship above the dial element and the upper end of the needle cylinder. Vertically extending rotatable drive shaft means is supported at the upper end on the frame support member and extends downward to a position adjacent the circular opening in the upper end of the needle cylinder.

The knitting machine is characterized by having vertically extending support sleeve means surrounding the drive shaft means. The support sleeve means is supported at the upper end on the frame support member for telescopic vertical movement relative to the drive shaft means. The lower end of the support sleeve means is fixed to the dial element for supporting same. Dial element control means is provided for lifting and lowering the support sleeve means along the drive shaft means and for lifting and lowering the dial element. The dial control means is operable to lift the dial element a sufficient distance for facilitating removal and replacement of the needle cylinder.

In one embodiment, the dial element includes a dial with dial needles supported for radial movement therein. In a second embodiment, the dial element supports yarn changing and selection devices, such as stripper boxes. The dial element control means is illustrated as including a rotatable worm gear and a rack meshing with the worm gear and supported for vertical movement in response to rotation of the worm gear.

BRIEF DESCRIPTION OF THE DRAWINGS

Some of the objects and advantages of the present invention having been stated, others will be more fully understood from the detailed description which follows and by reference to the accompanying drawings in which.

DESCRIPTION OF THE PREFERRED EMBODIMENT

Figure 1:
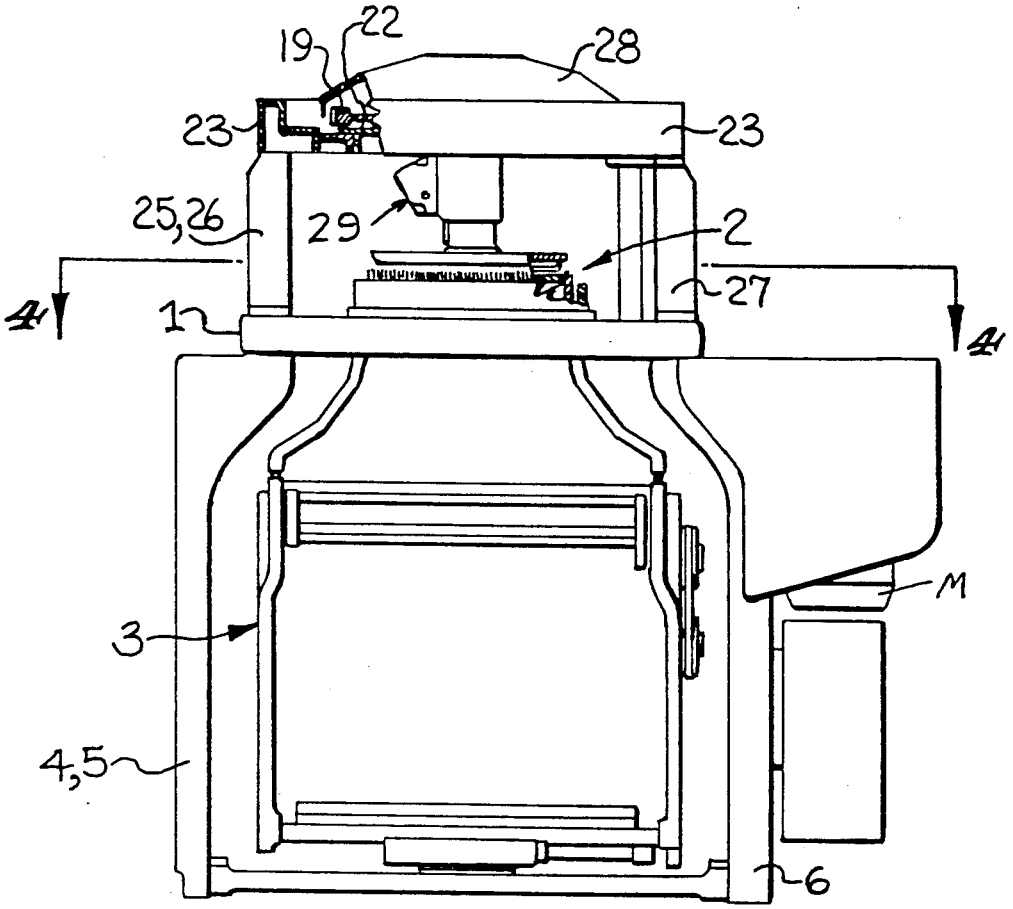
FIG. 1 is a schematic front elevational view of the knitting machine in accordance with the present invention and showing a portion of the dial drive cover broken away for illustrating some of the component parts of the knitting machine.

Referring now to the drawings, and more particularly to FIG. 1, there is illustrated a double knit circular knitting machine in accordance with the first embodiment of the present invention. A circular bed plate 1 is supported on the upper ends of three equally spaced support legs 4, 5 and 6, only two of which are illustrated. A knitting unit, broadly indicated at 2 is fixed on the bed 1 and operates to knit tubular fabric which is flattened, and wound onto a roll on a take-up device, broadly indicated at 3, positioned below the knitting unit 2.

Figure 2:
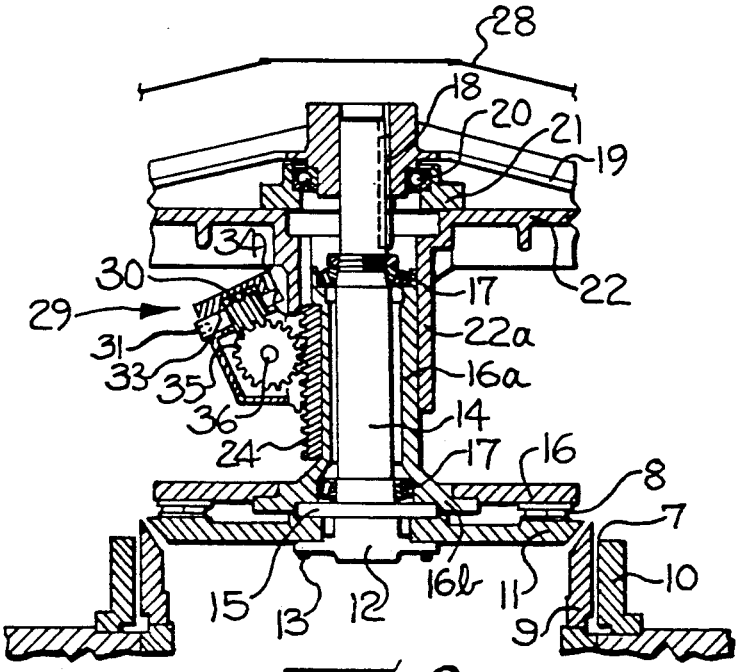
FIG. 2 is an enlarged vertical sectional view of the cylinder and dial and showing some of the component parts.

The knitting unit 2 includes a cylinder needle area 7, dial needle area 8 (FIG. 2) and conventional yarn carriers (not shown). The cylinder needle area 7 includes a plurality of needle grooves formed in the outer periphery of a needle cylinder 9, having a circular opening at the upper end thereof. Cylinder needles (not shown) are mounted for vertically sliding along the formed grooves. Needle activating cams (not shown) are mounted on a cam holder 10 for controlling movement of the cylinder needles during knitting. The dial needle area s includes dial element means including a dial 11 having dial grooves therein. Dial needles (not shown) are mounted in the grooves for radially sliding along the formed dial grooves. Dial needle activating cams (not shown) are positioned on a dial cam holder 16 and control movement of the dial needles. Drive means, in the form of a motor M, is positioned on the machine and rotates the needle cylinder 9 and dial 11 at the same speed. As illustrated in FIG. 2, the dial 11 is fixed to the underside of the lower end of a stepped portion 15 on the lower end of a dial drive shaft 14. The dial 11 is fixed on the lower end of the shaft 14 by a flange 12 and bolts 13.

The lower portion of the dial drive shaft 14 is rotatably supported by spaced bearings 17 positioned in an inner sleeve support member 16*a*. A hub 16*b* is provided on the lower end of the inner sleeve 16*a* and the dial cam holder 16 is fixed thereto. A rack 24 is mounted in a vertical position on the inner sleeve 16*a*. The upper portion of the inner sleeve 16*a* is fitted in close clearance fit for telescopic vertical movement in the lower portion of an outer sleeve support member 22*a* positioned outside the inner sleeve 16*a*. The upper end of the outer sleeve support member 22*a* is integrally formed with a frame support member 22 extending in spaced relationship above the needle cylinder 9. As shown in FIG. 1, the frame support member 22 is fixed to an outer sleeve support frame 23. The outer sleeve support frame 23 is fixed to the upper ends of three spaced vertical supports 25, 26 and 27, only two of which are shown, and the lower ends of which are supported on the bed plate 1. A drive gear 19 is drivingly connected to the upper end of the dial drive shaft 14 and is fixed thereto by a key 18. The upper end portion of the dial drive shaft 14 is vertically slidable along a key groove in the drive gear 19. The drive gear 19 rotates On a bearing 20 positioned in a bearing housing 21 mounted on the frame support member 22. A cover 28 extends over the drive gear 19 and is fixed to the outer sleeve support frame 23 for protecting the gear 19 from dust and other hazards.

Figure 3:
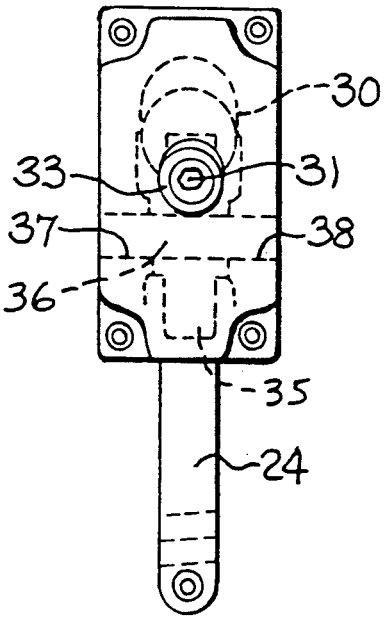
FIG. 3 is a fragmentary elevational view showing various components of the dial element control means.

In accordance with the present invention, dial element control means is provided for lifting and lowering the inner sleeve support member 16*a* along the dial drive shaft 14 and thereby lifting and lowering the dial element means fixed to the inner sleeve support member 16*a*. The dial element control means is operable to lift the dial element means a sufficient distance for facilitating removal and replacement of the needle cylinder 9. As illustrated, the dial element control means, broadly indicated at 29 in FIG. 2, includes a worm 30, a worm gear 35, and the rack 24. The worm 30 is secured to a worm shaft 31 rotatably supported by bearings 33, 34 at either end of the worm shaft 31. The worm gear 35 is fixed to a worm gear shaft 36. The worm gear shaft 36 is rotatably supported at opposite ends by bearings 37, 38 (FIG. 3).

METHOD OF OPERATION

The dial element control means is utilized for lifting the dial 11 a sufficient distance to permit removal and replacement of the needle cylinder 9. To this end, an operator turns the worm shaft 31 and worm 30 with means, such as a hexagonal wrench. As the operator turns the worm 30, the worm gear 35 is rotated to move the machine shaft 14 and the inner sleeve support member 16*a* upward. This upward movement of the inner sleeve support member 16*a* lifts the dial 11 out of the opening in the upper end of the needle cylinder provides a space above the cylinder 9. The flange 12 can then be removed so that the cylinder 9 and dial 11 then can be laterally moved through the open space and out from the knitting machine, as shown in dash-dot lines in the direction of the arrow in FIG. 4.

Figure 4:
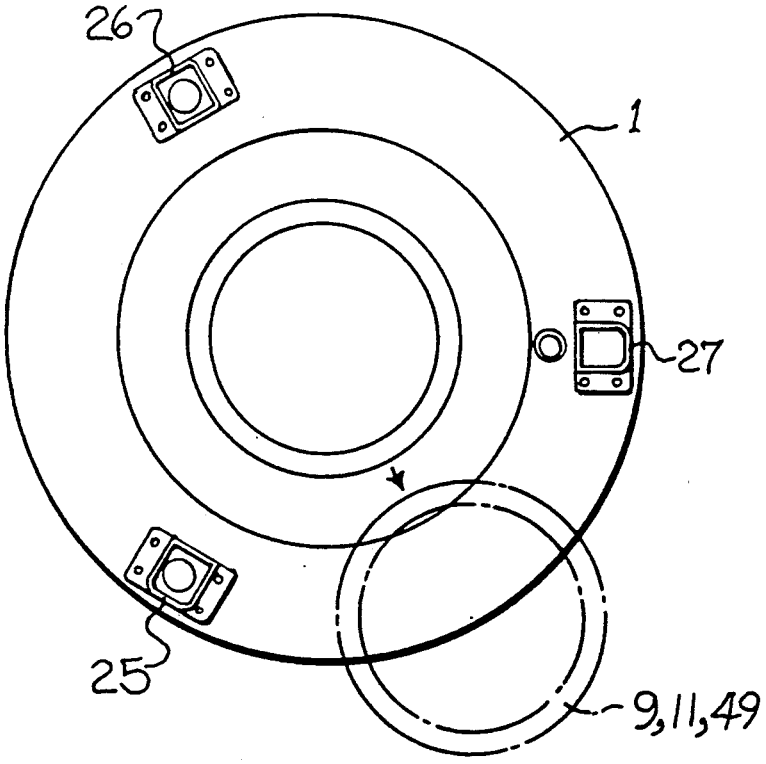
FIG. 4 is a somewhat schematic horizontal sectional view of the knitting machine, taken along line 4—4 of FIG. 1, and showing the removal of the cylinder and dial laterally therefrom.
Figure 5:
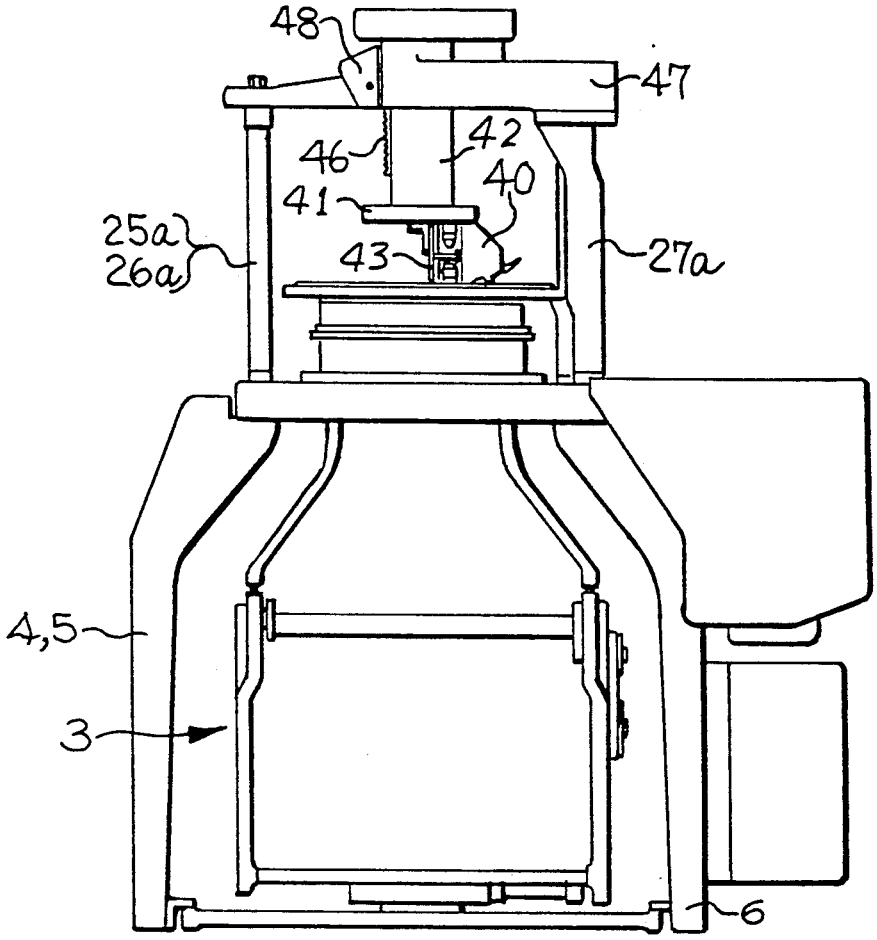
FIG. 5 is a front elevational view of a second embodiment of the knitting machine in accordance with the present invention having yarn-changing devices incorporated therewith.
Figure 6:
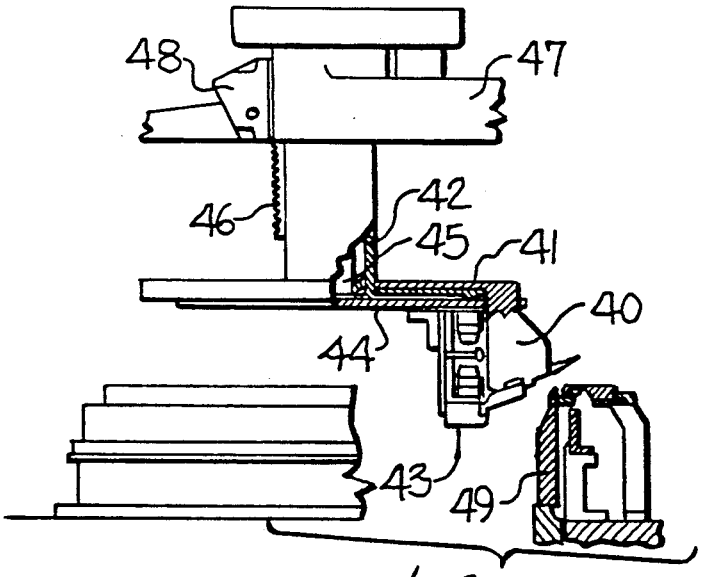
FIG. 6 is an enlarged diagrammatic elevational view of the dial and cylinder elements of the machine of FIG. 5, with parts in section and showing the yarn changing devices supported on the dial element.

A second embodiment of the present invention showing a single knit circular knitting machine is illustrated in FIGS. 5 and 6. Similar reference numerals as those in FIGS. 1 through 4 are used to designate similar components. As illustrated, the single knit circular knitting machine of this embodiment includes a yarn changing device 40 and a selection device 43. Both devices 40 and 43 are commonly referred to as a stripper box. The stripper box apparatus includes an electromagnet (not shown) positioned inward from the yarn changing device 40. An outer sleeve support frame 47 (FIG. 5) is fixed on the upper ends of spaced supports 25*a*, 26*a* and 27*a*.

As shown in FIG. 6, the yarn changing device 40 is fixed to the outer bottom portion of the dial element which includes a stationary support dial member 41, supported on an outer sleeve support member 42. On the inward side of the yarn changing device 40, the selection device 43 is fixed to a rotary support disk 44 fixed on the lower end of a machine shaft 45. A rack 46 is fixed to the outer sleeve support member 42. The outer sleeve support member 49 is vertically slidable in the outer sleeve support frame 47. Control means, such as a rack 46 and worm gear 48, are provided to raise and lower the outer sleeve support member 49 for raising and lowering the dial element.

The knitting machine can be operated in a similar manner such as described in the first embodiment so that a needle cylinder 49 and the dial element can be laterally removed from the knitting machine in the general direction of the arrow shown in FIG. 4.

The structure of the circular knitting machine in accordance with the present invention offers several benefits. The control means as described and illustrated offers several improvements over prior art knitting machines where the needle cylinder and dial element must be removed by means of a chain block hoist or the like. In the present invention, the needle cylinder and dial element can be laterally removed from the knitting machine. This facilitates repair of the knitting machine and quick-change of machine parts.

In the drawings and specification there has been set forth the best modes presently contemplated for the practice of the present invention, and although specific terms are employed, they are used in a service and descriptive sense only and not for purposes of limitation, the scope of the invention being defined in the claims.

That which is claimed is:

1. A circular knitting machine including a frame, a bedplate fixed on said frame, a needle cylinder supported for rotation on said bedplate and adapted to receive needles for vertical movement therein, said needle cylinder having a circular opening at the upper end thereof, dial element means supported adjacent the opening in the upper end of said needle cylinder, a frame support member extending in spaced relationship above said dial element means and the upper end of said needle cylinder, and vertically extending rotatable drive shaft means supported at the upper end on said frame support member and extending downwardly to a position adjacent the opening in the upper end of said needle cylinder, said circular knitting machine being characterized by:

(a) vertically extending support sleeve means surrounding said drive shaft means for supporting same and comprising an outer sleeve fixed to said frame support member and extending downwardly therefrom, an inner sleeve supported for vertical sliding movement relative to said outer sleeve and wherein said inner sleeve supports said dial element means thereon, and (b) dial element control means for lifting and lowering said inner sleeve along said drive shaft means and thereby lifting and lowering said dial element means supported thereon, said dial element control means being operable to lift said dial element means a sufficient distance to permit removal and replacement of said needle cylinder.

2. A circular knitting machine according to claim 1 wherein said dial element means includes a dial adapted to receive dial needles for radial movement therein, and a dial cam holder including dial cams for controlling radial movement of dial needles.

3. A circular knitting machine according to claim 1 wherein said dial element means includes yarn change devices supported thereby and extending downwardly therefrom and into the open end of said needle cylinder.

4. A circular knitting machine according to claim 1 wherein said dial element control means includes a rotatable worm gear, and a rack meshing with said worm gear and supported for vertical movement in response to rotation of said worm gear.

5. A circular knitting machine according to claim 4 wherein said worm gear is supported on said outer sleeve and said rack is supported on said inner gear.

* * * * *

UNITED STATES PATENT AND TRADEMARK OFFICE

CERTIFICATE OF CORRECTION

PATENT NO. : 5,099,661

DATED : 31 March 1992

INVENTOR(S) : Kyoya Kitagawa

It is certified that error appears in the above-identified patent and that said Letters Patent is hereby corrected as shown below:

Column 3, line 3, "area s" should read --area 8--.

Column 3, line 39, "rotates On" should read --rotates on--.

Column 4, line 30, "member 49" should read --member 42--.

Column 4, line 33, "member 49" should read --member 42--.

Claim 5, column 6, line 19, "gear" should read --sleeve--.

Signed and Sealed this

Thirty-first Day of August, 1993

*Attest:*

Bruce Lehman

BRUCE LEHMAN

*Attesting Officer*

*Commissioner of Patents and Trademarks*